US005775787A

United States Patent [19]

Gasser

[11] Patent Number: 5,775,787

[45] Date of Patent: Jul. 7, 1998

[54] PULL-OUT GUIDE ASSEMBLY FOR DRAWERS OR THE LIKE

[75] Inventor: Ingo Gasser, Höchst, Austria

[73] Assignee: Julius Blum Gesellschaft m.b.H., Hochst, Austria

[21] Appl. No.: 783,106

[22] Filed: Jan. 14, 1997

[30] Foreign Application Priority Data

Nov. 5, 1996 [AT] Austria ..... 640/96

[51] Int. Cl.[6] ..... A47B 88/00

[52] U.S. Cl. ..... 312/334.12; 312/333; 312/334.46

[58] Field of Search ..... 312/330.1, 333, 312/334.6, 334.13, 334.14, 334.15, 334.44, 334.46, 334.12, 334.1, 334.5; 384/19, 23, 18, 21

[56] References Cited

U.S. PATENT DOCUMENTS

| | | | |
|---|---|---|---|
| 1,365,523 | 1/1921 | Meilink | 312/334.12 |
| 4,560,212 | 12/1985 | Papp et al. | 384/18 |
| 4,563,044 | 1/1986 | Rees | 384/18 |
| 4,692,035 | 9/1987 | Rock et al. | 384/21 X |
| 4,765,699 | 8/1988 | Bessinger et al. | 312/334.46 |
| 4,938,609 | 7/1990 | Brüstle . | |
| 5,344,227 | 9/1994 | Rock et al. | 312/334.6 |

FOREIGN PATENT DOCUMENTS

| | | | |
|---|---|---|---|
| 295 10 609 U | 10/1995 | Germany . | |
| 195 35 013 | 4/1996 | Germany . | |
| 6245831 | 9/1994 | Japan | 312/334.44 |

*Primary Examiner*—Peter M. Cuomo
*Assistant Examiner*—Janet M. Wilkins
*Attorney, Agent, or Firm*—Wenderoth, Lind & Ponack

[57] ABSTRACT

A pull-out guide assembly for use on each of opposite sides of a drawer for guiding the movement of the drawer into and out of the body of an article of furniture includes a supporting rail to be mounted on a respective side of the body of the article of furniture, a pull-out rail to be mounted on a respective side of the drawer and a center rail positioned between the rails for enabling relative longitudinal movement therebetween. A recess is formed in the front end of the center rail. A stop member operative between the pull-out rail and the center rail limits the extent of longitudinal movement of the pull-out rail relative to the center rail in a direction of extraction of the pull-out rail from the center rail. The stop member is a lug projecting horizontally underneath the center rail and a tiltable flap situated above the center rail. In the retaining position the horizontal lug is positioned underneath the recess in the center rail, the recess being open solely to the bottom of the center rail.

14 Claims, 12 Drawing Sheets

PULL-OUT GUIDE ASSEMBLY FOR DRAWERS OR THE LIKE

FIELD AND BACKGROUND OF THE INVENTION

The invention relates to a pull-out guide assembly for a drawer or the like. Pull-out guide assemblies which comprise at each side of a drawer a supporting rail on the body of an article of furniture, a center rail and a pull-out rail fastened to the drawer provide the advantage to that the drawer can be fully extracted from the body of the article of furniture so that objects stored in the rear region of the drawer are more easily accessible. The three rails at each drawer side are provided with stop members which should prevent unintended extraction of the center rail from the supporting rail and of the pull-out rail from the center rail, which extraction would cause the drawer to fall to the floor.

Such an assembly is shown in U.S. Pat. No. 4,938,609.

SUMMARY OF THE INVENTION

It is an object of the invention to improve such a pull-out guide assembly, so that while the drawer is securely held in the assembly during normal operation, the removal of the drawer, for example for the purpose of cleaning the later, is facilitated.

According to the invention that is achieved in that a stop member is mounted on the pullout rail, such stop member including a lug projecting horizontally underneath the center rail and a tiltable flap situated above the center rail. In the retaining position, the horizontal lug is positioned underneath a recess in the center rail. Such recess is open solely to the bottom of the center rail.

For removing the drawer together with the pull-out rail from the center rails, the drawer has to be lifted at its front side and be pulled slightly forward. Thereafter, the drawer is lowered again, whereby the tiltable flap abuts the center rail from above. In this position the center rail can be overrun by the tiltable flap when the pull-out rail is moved further out of the piece of furniture. This combination of lifting and lowering the drawer guarantees that the drawer can not be removed unintentionally from the assembly. Otherwise, the operation of lifting and lowering the drawer is very easy. If the drawer has to be removed from the assembly it is very easy to do so. It is notable that no arresting or abutting means such as screws, clamps or the like have to be removed from the pull-out rail or the center rail.

It is advantageously provided that both the horizontal lug and the tiltable flap are provided on a common block made of plastic material which is fastenable on the pull-out rail. This arrangement facilitates mounting of the tiltable flap and lug on the pull-out rail. It is further advantageously provided that the block is mounted in a recess of the pull-out rail. By this arrangement the assembly can be kept very slim.

To facilitate transport of the piece of furniture when the drawers are already mounted in therein, a preferred embodiment of the invention provides that the recess has a front boundary defined by a web of a vertical flange. A further recess is provided in front of the web. A further horizontally projecting lug of the pull-out rail projects into the further recess when the pull-out rail and the center rail are in a fully closed position.

BRIEF DESCRIPTION OF THE DRAWINGS

In the following an embodiment of the invention will be described in more detail with reference to the accompanying drawings, in which.

DESCRIPTION OF THE PREFERRED EMBODIMENT

Figure 1A:
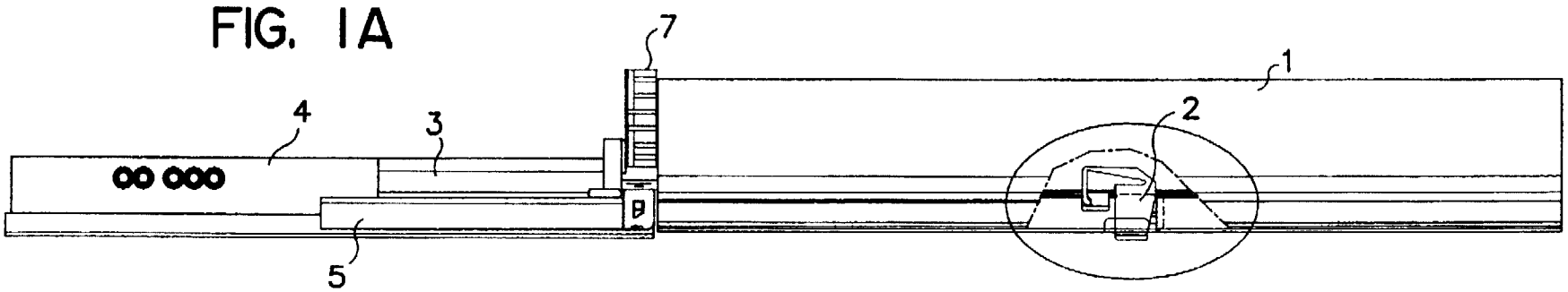
FIG. 1*a* is a side view of an assembly and a drawer being moved into a front end position.
Figure 1B:
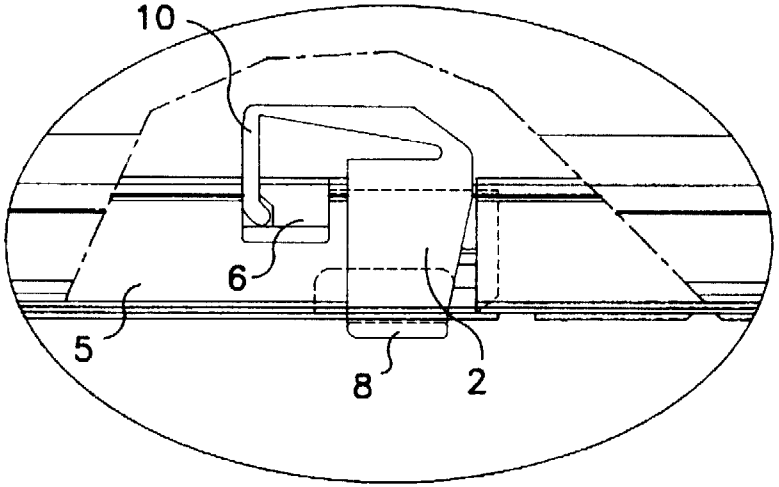
FIGS. 1*b*, 2*b*, 3*b* and 4*b* are enlarged views of details of FIGS. 1*a*, 2*a*, 3*a* and 4*a*; respectively.
Figure 2A:
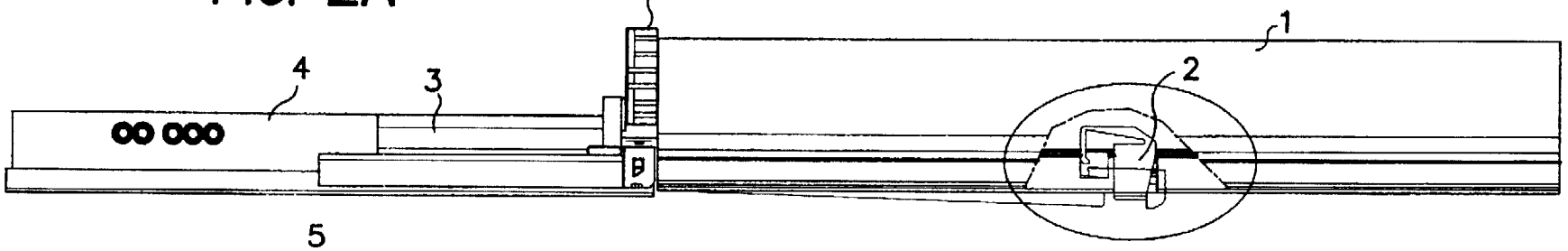
FIG. 2*a* is a side view of the assembly and the drawer in the front end position, with the drawer and a pull-out rail being tilted upwardly.
Figure 2B:
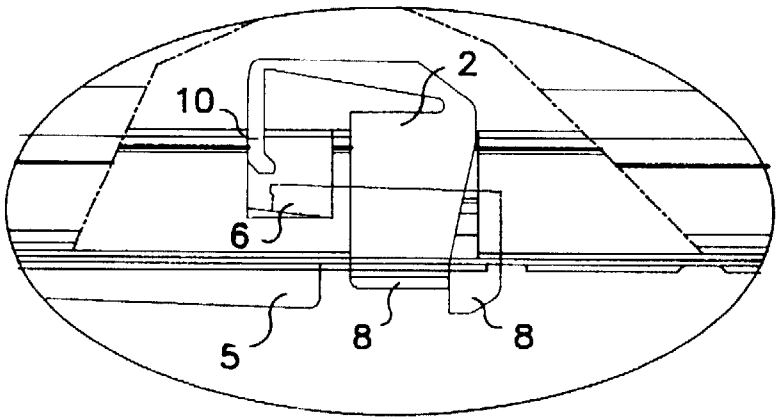
Figure 3A:
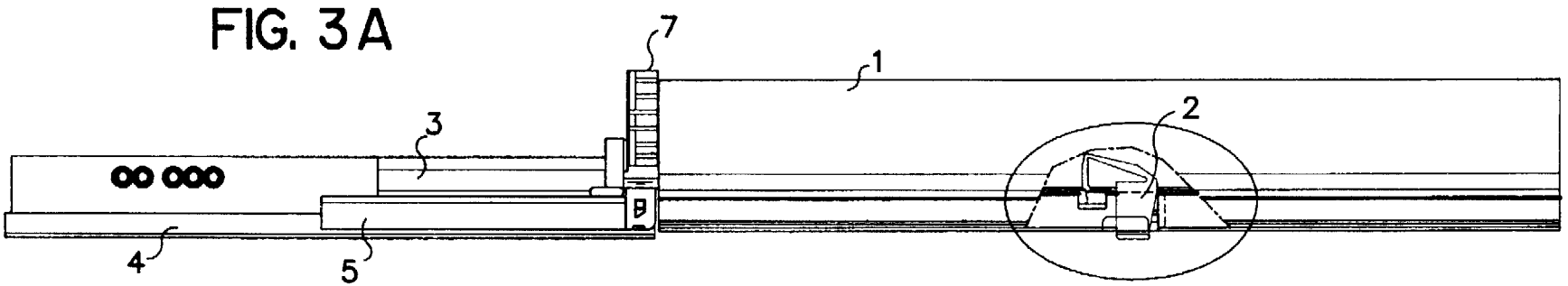
FIG. 3*a* is a side view of the assembly and the drawer in the front end position after the drawer has been lowered again.
Figure 3B:
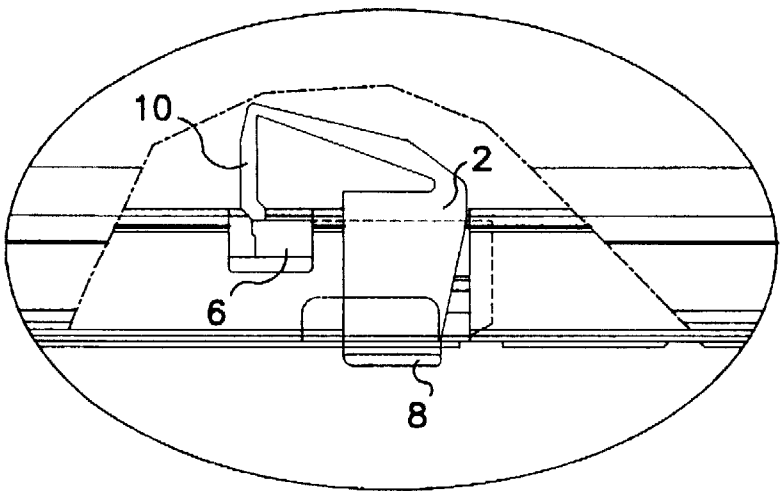

In the drawings, furniture components such as a side of a body of an article of furniture, a furniture side wall and a complete drawer are not shown since they are made according to the state of the art and are not part of the present invention. Further, only the rails of the assembly on one side of the drawer are shown, the parts of the assembly on the other side being structured similarly.

The pull-out guide assembly comprises, at each side of the drawer a supporting rail 4 for fastening to a side wall 15 of a piece of furniture. A pull-out rail 13 is to be fastened to a side of the drawer and a center rail 5 is positioned between the support rail 4 and the pull-out rail 13. The pull-out rail 13 is mounted with a drawer wall side 1 and a bottom plate 14 of the drawer is suspended by a horizontal flange 18 of the pull-out rail 13.

Figure 4A:
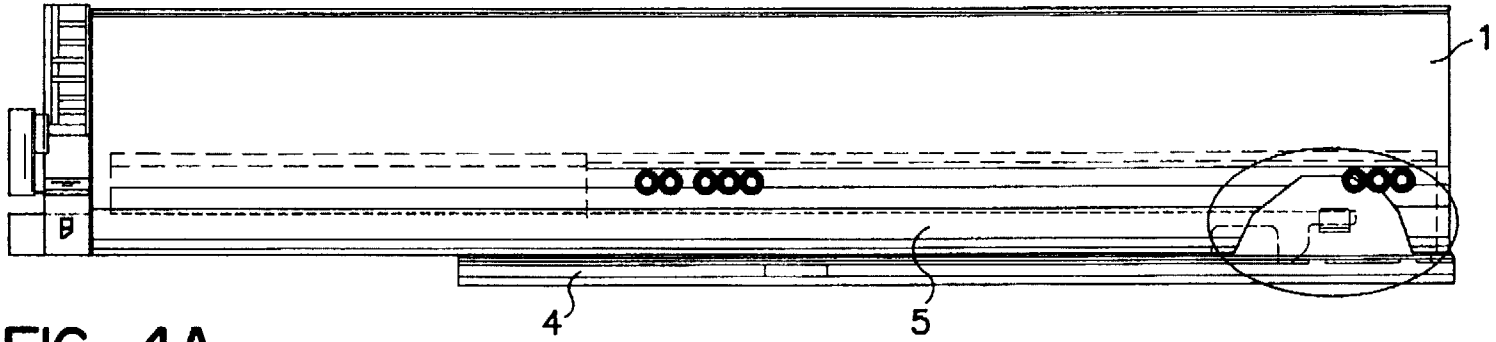
FIG. 4*a* side view of the assembly and the drawer in a rear end position.
Figure 4B:
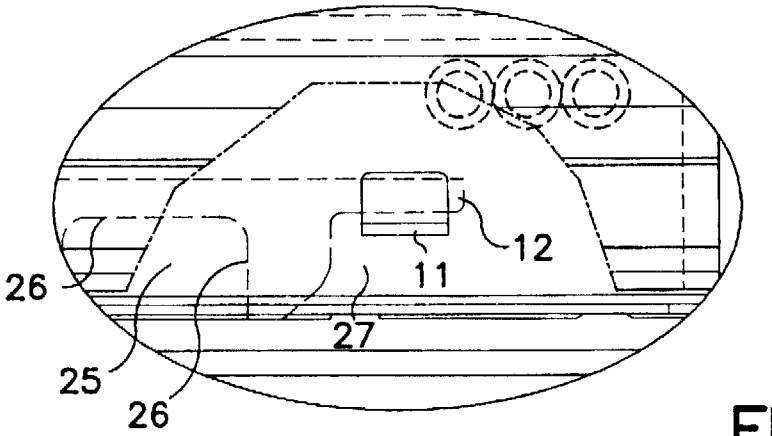
Figure 5:
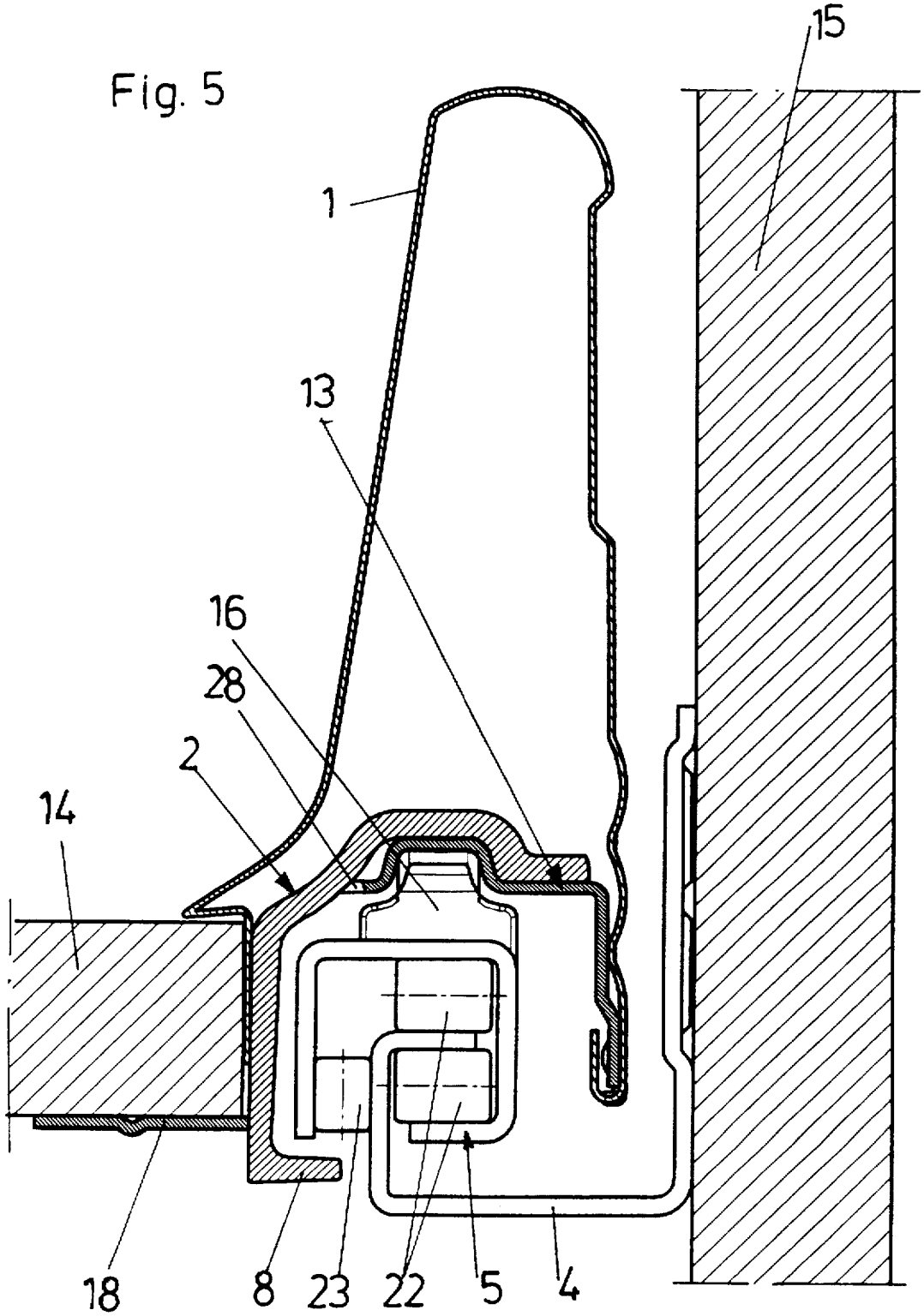
FIG. 5 is a sectional view of a drawer side wall and the assembly.
Figure 6:
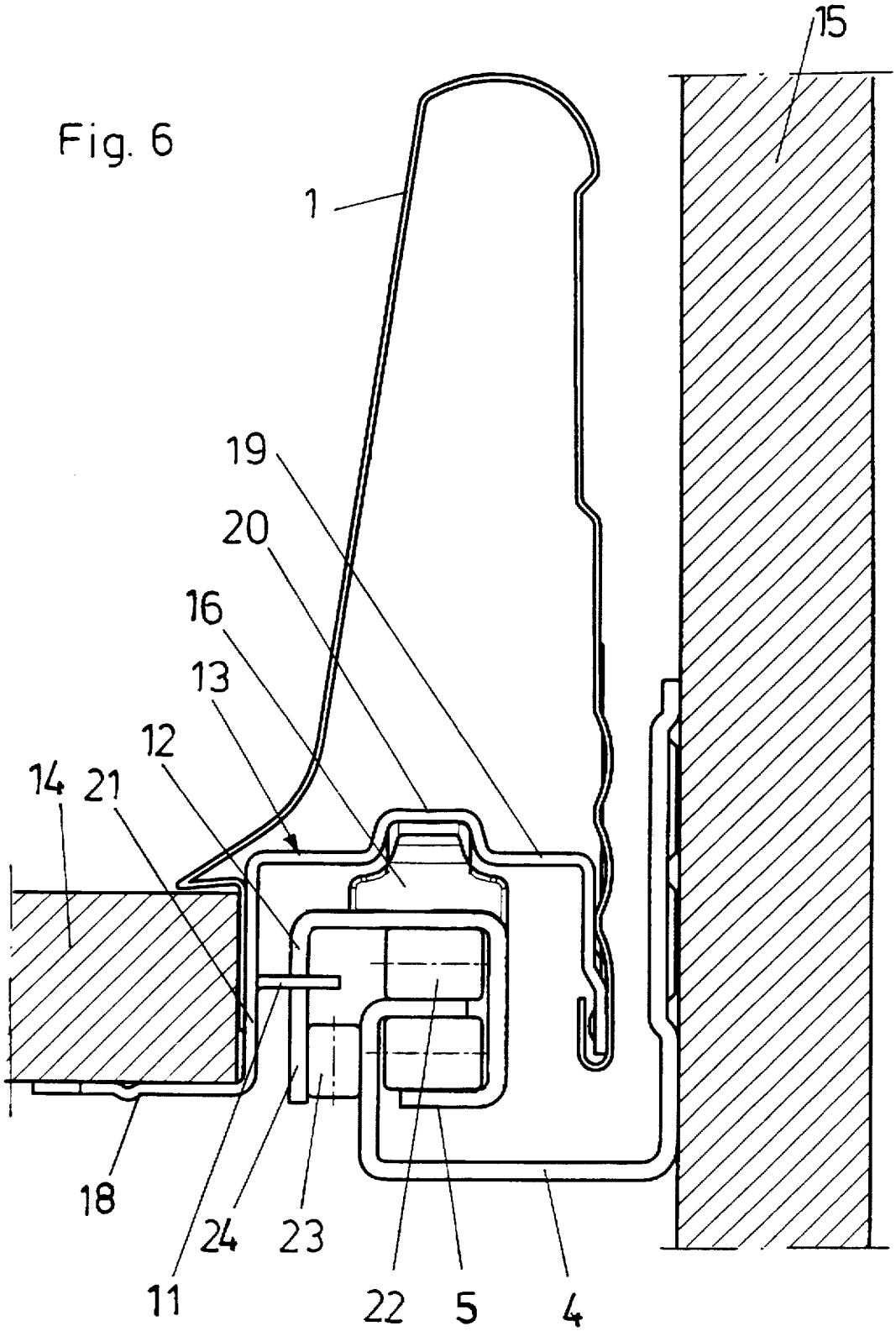
FIG. 6 is front view of the drawer side wall and the assembly.

Running flange 19 of the pull-out rail 13 is provided with a groove 20 in which a roller 17 mounted on the center rail 5 is guided. Vertical flange 21 of the pull-out rail 13 by means of which the running flange 19 is joined to the horizontal flange 18 is provided with a horizontal lug 11 which acts as a support for the drawer during transportation of the piece of furniture. The lug 11 abuts nose 12 of the center rail 5 and prevents the drawer from being lifted from the center rail unintentionally (FIG. 4*b*). The center rail 5 is movable on the support rail 4 by means of rollers 22 and side stabilizing rollers 23 which are mounted in a separate roller carrier. At the rear end of the pull-out rail 13 rollers are mounted for running on the center rail 5. At the front end of the center rail 5 is provided a roller carrier 16 in which a roller 17 is mounted. The running flange 19 of the pull-out rail 13 is moveable on the roller 17. Vertical flange 24 of the center rail is provided with a recess 25 which is situated underneath the roller carrier 16. The recess 25 is open to the bottom of the vertical flange 24 and is limited by edges 26 of the vertical flange 24 at the rear, at the front and at the top. In front of the recess 25 a second recess 27 is provided in a flange position 9. This recess is open to the bottom and to the front (FIGS. 7a–8c). At the rear face of the roller carrier 16 is a stop 6 for limiting the position of the pull-out guide assembly on the center rail 5.

At block 2 is provided in a recess 28 of the pull-out rail 13. The block 2 is preferably made of plastic material. A horizontal lug 8 is provided at the bottom and a vertical tiltable flap 10 at the top of the block 2. The tiltable flap 10 is connected to the block 2 by means of an arm 30 projecting rearwardly from the block 2. The tiltable flap 10 is tiltable in a vertical plane. The flap 10 is made in one piece with the arm 30 and the block 2. The ability of the tiltable flap 10 to move is made possible by the elasticity of the plastic material. In the locking position the flap 10 is aligned vertically and projects through and opening 31 in the running flange 19 of the pull-out rail 13.

Figure 7A:
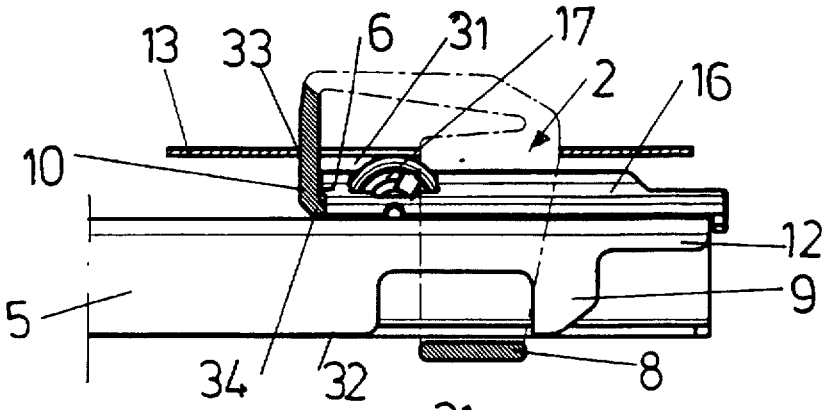
FIGS. 7*a*, 7*b* are side views of stop members on a center rail and the pull-out rail, and in which removal of the drawer is shown sequentially.

During normal operation, that is the normal in-and outward movement of the drawer, the horizontal lug 8 is positioned underneath lower edge 32 of the vertical flange 24 of the center rail 5. When the pull-out rail 13 is in its front end-position the flap 10 abuts the stop 6 on the roller carrier 16 as shown in FIG. 7a and therefore makes further extraction of the pull-out rail 13 impossible. The tiltable flap 10 is pressed to rear edge 33 of the opening 31.

Figure 7B:
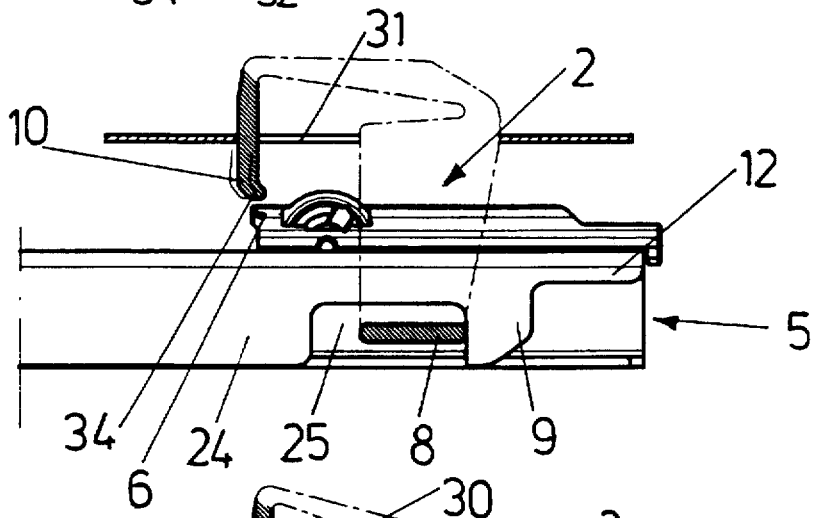
Figure 7C:
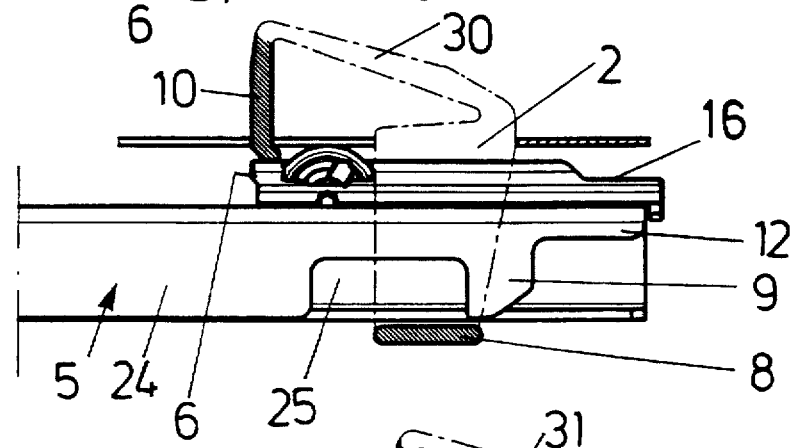
Figure 7D:
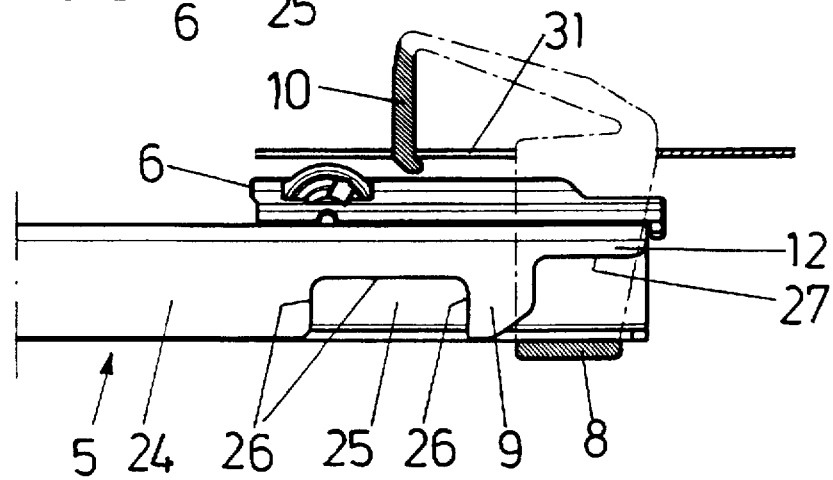

If the drawer is to be removed from the pull-out guide assembly and the pull-out rail 13 is to be disengaged from the center rail 5, the drawer is tilted upwardly at the front and brought into the position shown in FIG. 7b. In this position the horizontal lug 8 projects into the recess 25. This lifting of the drawer is not sufficient to remove the drawer from the pull-out guide assembly because the lug 8 abuts the front edge 26 of the recess 25, thus preventing the removal of the pull-out rail 13 from the center rail 5. However, the drawer is moved forward slightly and the tiltable flap 10 is lifted over the stop 6 and is situated above the roller carrier 16. After lowering the drawer as shown in FIG. 7c, end 34 of the tiltable flap 10 abuts the roller carrier 16 from above. As the horizontal lug 8 is now again positioned underneath the lower edge 32 of the vertical flange 24, the drawer can be pulled further out of the piece of furniture and the pull-out rail 13 can be removed from the center rail 5 (FIG. 7d). The elasticity of the tiltable flap 10 makes it possible to move the tiltable flap 10 over the roller 17.

Figure 8A:
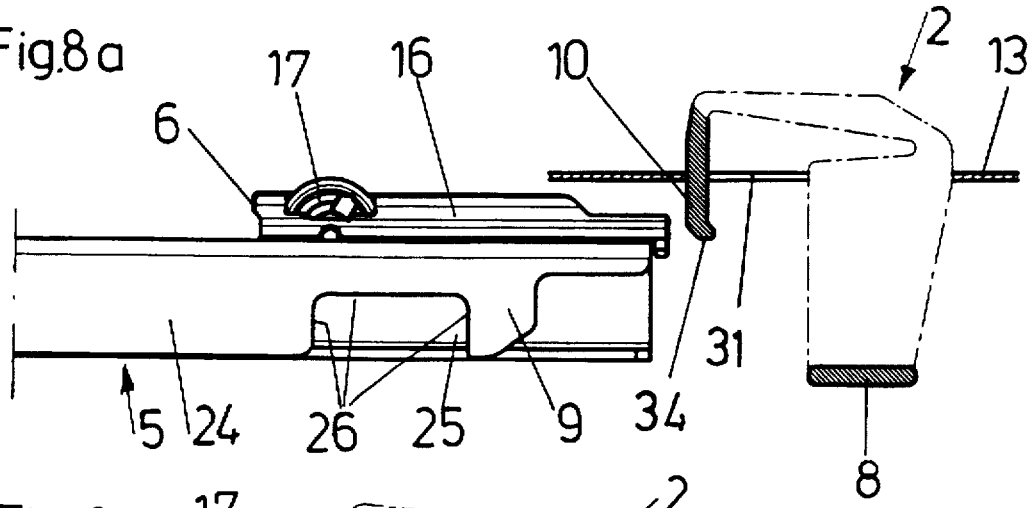
FIGS. 8*a*, 8*c* are side views of the stop members on the center rail and on the pull-out rail in relationship each other while the drawer with the pull-out rail is being inserted.
Figure 8B:
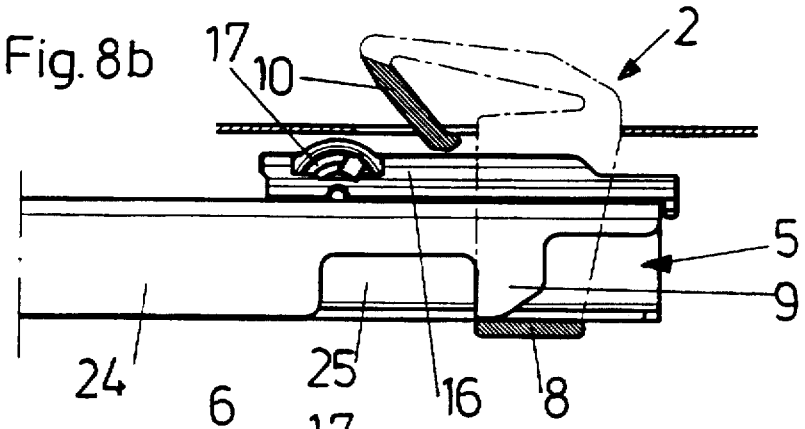
Figure 8C:
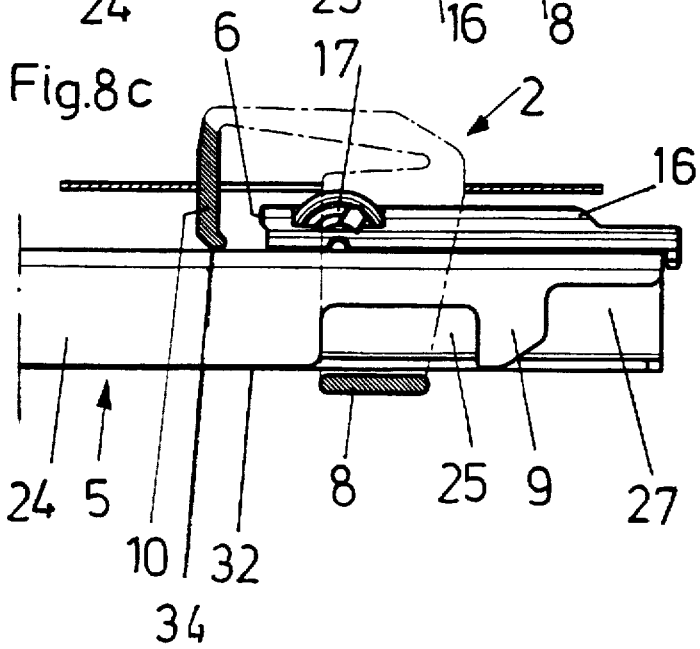

The insertion of the drawer is shown in FIGS. 8a to 8c. When the pull-out rail 13 in the position of FIG. 8a is pushed onto the center rail 5, the liftable flap 10 abuts the front end of the roller carrier 16 and is thereby tilted as shown in FIG. 8b. As soon as the flap 10 has been moved over the roller carrier 16 the flap 10 is brought into a vertical position (perpendicular to the pull-out rail 13 and the center rail 5) by means of the elasticity of the plastic material. This position is shown in FIG. 8c. In this position the pull-out guide assembly is in the operating position.

Figure 9:
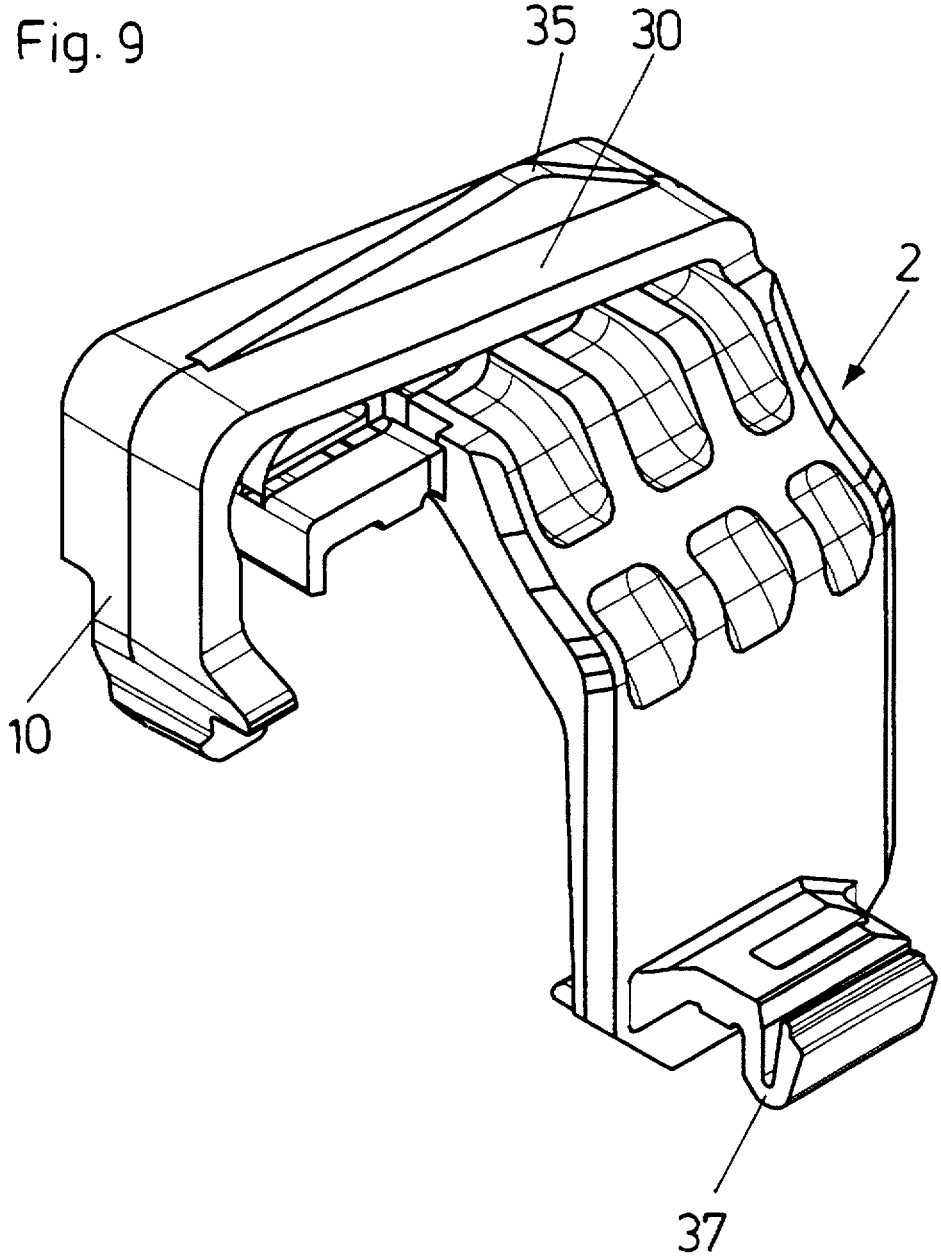
FIGS. 9 to 11 are perspective view of a block having a horizontal lug and a tiltable flap.
Figure 10:
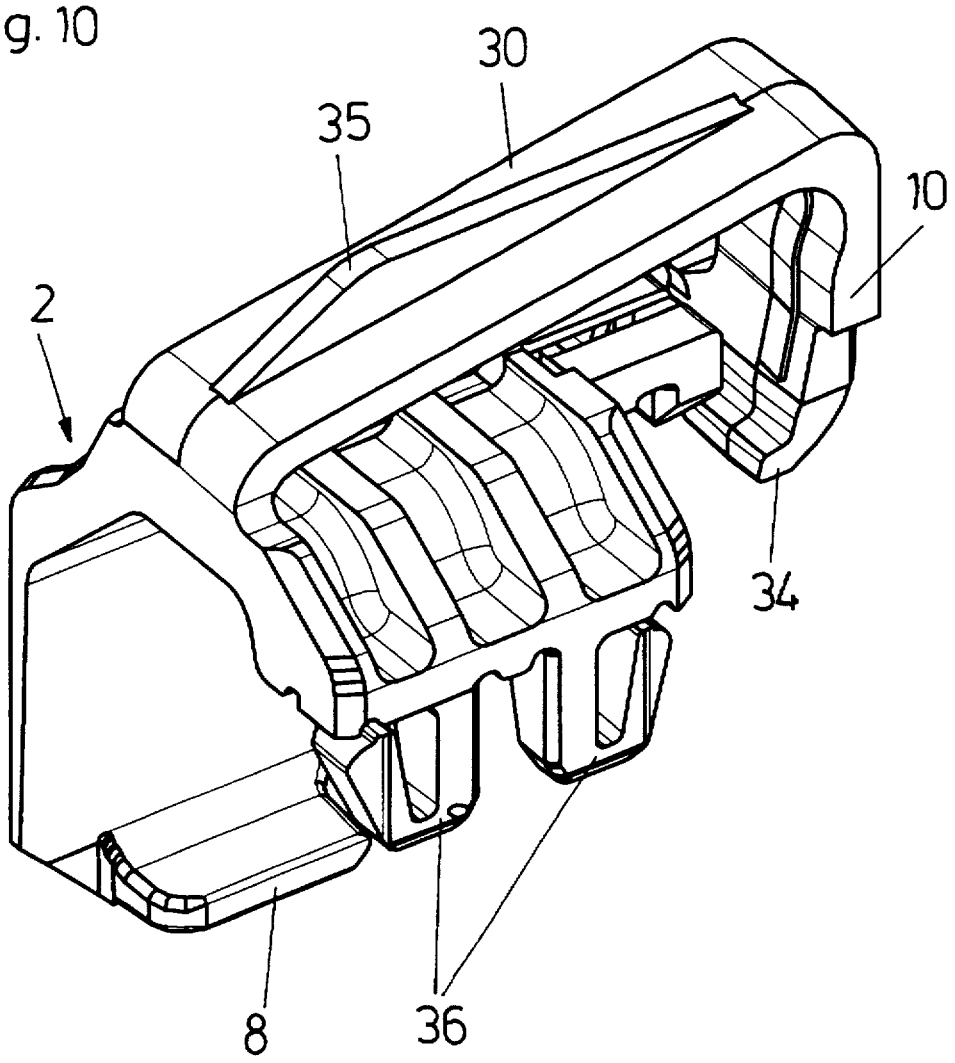
Figure 11:
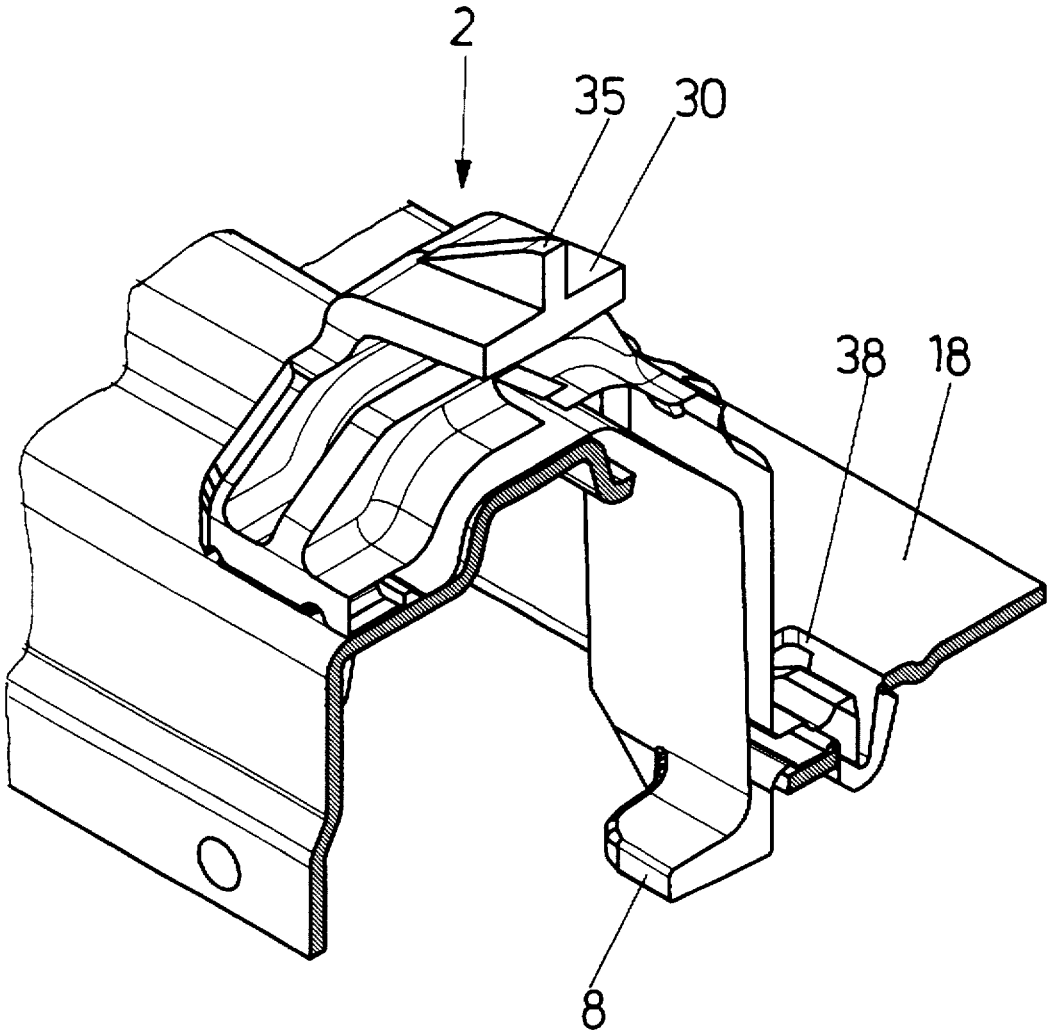
Figure 12:
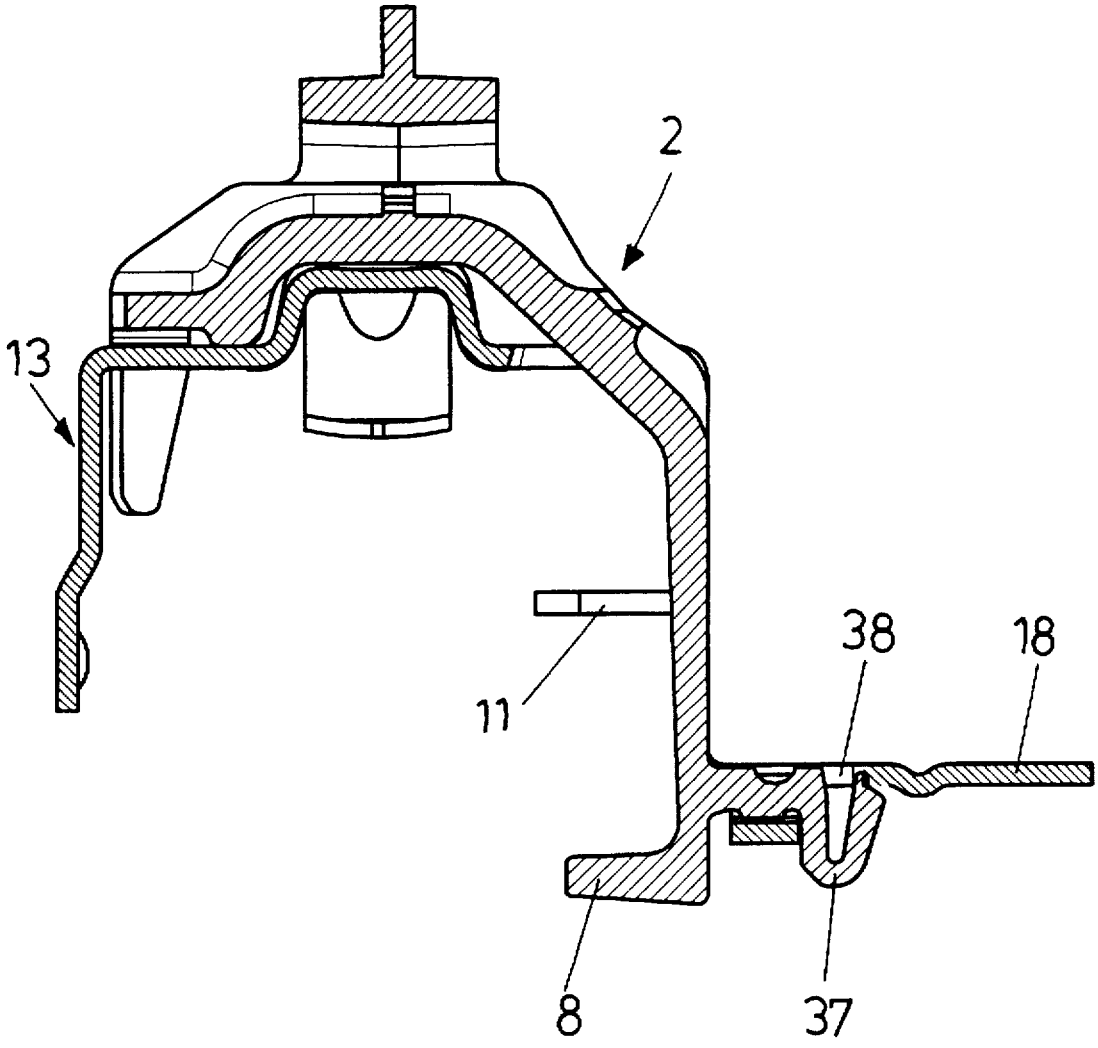
FIG. 12 is a sectional view of such block.

As can be seen from FIGS. 9 and 10 the block 2, the horizontal lug 8, the tiltable flap 10 and the arm 30 which carries the tiltable flap 10 are made in one piece, preferably by injection molding. The arm 30 is provided with a reinforcement rib 35. The block 2 is also provided with hooks 36, 37 by means of which the block 2 is secured to the pull-out rail 13. The hook 37 projects into a hole 38 of the horizontal flange 18 of the pull-out rail 13 (FIG. 12).

What is claimed is:

1. A pull-out guide assembly for use on each of opposite sides of a drawer for guiding the movement of the drawer into and out of the body of an article of furniture, said assembly comprising:

a supporting rail to be mounted on a respective side of the body of the article of furniture;

a pull-out rail to be mounted on a respective side of the drawer;

a center rail having a forward end and a recess adjacent said forward end, said recess being open solely toward a bottom of said center rail;

supporting rollers mounted between said rails and enabling relative longitudinal movement therebetween to a fully extracted position, whereat said center rail is moved outwardly relative to said supporting rail, said pull-out rail is moved outwardly relative to said center rail, and said pull-out rail is moved further outwardly relative to said supporting rail than is said center rail; and a stop member mounted on said pull-out rail and operable on said center rail to limit the extent of movement therebetween in said fully extracted position, said stop member including a lug projecting horizontally beneath said center rail and positioned underneath said recess and a tiltable flap positioned above said center rail.

2. An assembly as claimed in claim 1, wherein said tiltable flap is tiltable in a vertical plane.

3. An assembly as claimed in claim 1, wherein said tiltable flap extends through an opening in a horizontal running flange of said pull-out rail.

4. An assembly as claimed in claim 1, wherein said tiltable flap extends perpendicular to said center rail in an abutment position thereof and is tiltable out of said position toward a front end of said pull-out rail.

5. An assembly as claimed in claim 1, wherein said horizontal lug and said tiltable flap are formed on a common block fastened to said pull-out rail.

6. An assembly as claimed in claim 5, wherein said block is formed of plastic material.

7. An assembly as claimed in claim 5, wherein said block includes a spring hook locking said block to said pull-out rail.

8. An assembly as claimed in claim 5, wherein said tiltable flap is connected to said block by an arm extending therefrom.

9. An assembly as claimed in claim 8, wherein said arm has a reinforcing web.

10. An assembly as claimed in claim 5, wherein said block is positioned in a recess in said pull-out rail.

11. An assembly as claim 1, further comprising a stop on said center rail to be abutted by said tiltable flap, and wherein said recess is provided in a vertical flange of said center rail, and said lug projects into said recess when said tiltable flap abuts said stop and said pull-out rail is tilted upwardly relative to said center rail.

12. An assembly as claimed in claim 11, wherein said stop is defined by a roller carrier for a said roller mounted on said center rail.

13. An assembly as claimed in claim 12, wherein said roller carrier includes a projection abutting said forward end of said center rail.

14. An assembly as claimed in claim 11, wherein said recess has a front boundary defined by a web of said vertical flange, and further comprising a further recess formed forwardly of said web, and a further horizontally extending lug projecting from said pull-out rail and projecting into said further recess when said pull-out rail and said center rail are in a fully inserted position relative to said supporting rail.

* * * * *